US005956554A

United States Patent [19]

Yanashima et al.

[11] Patent Number: 5,956,554

[45] Date of Patent: Sep. 21, 1999

[54] SHEET DRYING PREVENTION DEVICE

[75] Inventors: Tsukasa Yanashima; Tomoyuki Nishikawa, both of Tokyo, Japan

[73] Assignee: Asahi Kogaku Kogyo Kabushiki Kaisha, Tokyo, Japan

[21] Appl. No.: 08/620,303

[22] Filed: Mar. 22, 1996

[30] Foreign Application Priority Data

Mar. 25, 1995 [JP] Japan ..... 7-091442

[51] Int. Cl.[6] ..... G03G 15/20

[52] U.S. Cl. ..... 399/328; 399/384

[58] Field of Search ..... 355/215, 282, 355/285, 289, 290, 309; 219/216; 399/92, 328, 330, 384

[56] References Cited

U.S. PATENT DOCUMENTS

| | | | |
|---|---|---|---|
| 4,202,618 | 5/1980 | Waschik et al. | 219/216 X |
| 4,693,588 | 9/1987 | Yarbrough et al. | 219/216 X |
| 5,038,170 | 8/1991 | Serita | 355/200 |
| 5,063,416 | 11/1991 | Honda et al. | 355/316 |
| 5,073,796 | 12/1991 | Suzuki et al. | 355/215 |
| 5,155,539 | 10/1992 | Yamaguchi et al. | 355/315 |
| 5,325,158 | 6/1994 | Guelfo et al. | 355/215 |
| 5,355,203 | 10/1994 | Nishikawa et al. . | |
| 5,432,593 | 7/1995 | Nishikawa et al. | 355/290 |
| 5,475,481 | 12/1995 | Nishikawa et al. | 355/282 |
| 5,479,242 | 12/1995 | Sato et al. | 355/215 |
| 5,549,401 | 8/1996 | Ishikawa et al. | 400/618 |
| 5,557,388 | 9/1996 | Creutzmann et al. | 355/312 |

FOREIGN PATENT DOCUMENTS

| | | |
|---|---|---|
| 4034499 | 5/1991 | Germany . |
| 61-254972 | 11/1986 | Japan . |
| 62-081682 | 4/1987 | Japan . |
| 2-103076 | 4/1990 | Japan . |
| 3-069980 | 3/1991 | Japan . |
| 4-096077 | 3/1992 | Japan . |

*Primary Examiner*—Robert Beatty
*Attorney, Agent, or Firm*—Greenblum & Bernstein P.L.C.

[57] ABSTRACT

A printer has one or more fans in the vicinity of a fixing device to blow air directly onto a continuous form when printing is stopped and when rollers in the fixing device are separated. The fan or fans can be provided on a pressure roller side of the continuous form, in which case the continuous form shields a heat roller from the air flow of the fans. In the alternative, the fan or fans can be on the heat roller side, in which case a shield extending along the circumference of the heat roller, duct, or both is used to protect the heat roller from the air flow and/or the continuous form from direct heat radiation. A pair of rollers are disposed downstream of the fixing device and are rotated while the continuous form is stopped so as to maintain tension on the continuous form.

32 Claims, 14 Drawing Sheets

SHEET DRYING PREVENTION DEVICE

BACKGROUND OF THE INVENTION

The present invention relates to an electrophotographic printer employing a continuous form (recording sheet), and more particularly, to a device for preventing heating and drying of the continuous form.

In a conventional electrophotographic printer, a recording sheet is fed through a fixing pair of rollers (a heat roller and pressure roller). A toner image thereon is fused by heat and pressure. When a continuous form is used as the recording sheet, the continuous sheet is sometimes maintained in a stationary position between the heat and pressure rollers when the printer is idle (i.e., not actively printing an image). In this case, the continuous form can become heated and unusually dry.

In previous continuous form electrophotographic printers, blank, previously discharged (output) portions of a form are retracted and printed upon in order to efficiently use all the available printing space. In such a printer, printing on a portion of a form that has been changed from being held stationary in the fixing unit produces poor printing quality, such as poor toner transfer or a displaced transfer.

SUMMARY OF THE INVENTION

It is therefore an object of the present invention to provide an improved mechanism to prevent a continuous form from overheating in an electrophotographic printer, and preventing the continuous form from drying or otherwise deforming.

In order to satisfy the objects of the invention, a sheet drying prevention device for an electrophotographic printer employing a continuous form includes an imaging mechanism forms a toner image on the continuous form. A fixing mechanism fixes the toner image onto the continuous form. The fixing mechanism includes a pressure roller and a heat roller between which the continuous form passes. A drive mechanism drives and stops the continuous form along a feeding path from the imaging mechanism to the fixing mechanism. A separating mechanism moves the heat roller and the pressure roller both away from each other and together to nip the continuous form therebetween. At least one fan blows air onto the continuous form in the vicinity of the fixing mechanism. A controller controls the separating mechanism and the at least one fan. The controller also moves the heat roller and the pressure roller away from each other, and starts the at least one fan, in response to the continuous form being stopped along the feeding path by the drive mechanism.

Accordingly, when the continuous form is stopped along the sheet feeding path, the fan or fans cool the continuous form, which prevents the continuous form from overheating, drying or deforming.

According to another aspect of the invention, a sheet drying prevention device for a continuous form electrophotographic printer includes a feeding path along which the continuous form is fed and stopped. A fixing mechanism fixes a toner image onto the continuous form. The fixing mechanism includes a pressure roller and a heat roller between which the continuous form passes. A separating mechanism moves the heat roller and the pressure roller both away from each other, and together to nip the continuous form therebetween. At least one fan blow air onto the continuous form in the vicinity of the fixing mechanism in response to the heat roller and the pressure roller moving away from each other.

Accordingly, when the heat roller and pressure roller are separated from each other, the fan or fans cool the continuous form, preventing the continuous form from overheating, drying or deforming.

Preferably, the separating mechanism moves the continuous form away from the heat roller in response to the continuous form being stopped along the feeding path by the drive mechanism. That is, the separating mechanism moves the continuous form away from the heat roller in response to movement of the heat roller and the pressure roller away from each other by the separation mechanism. Thus, the heat roller is spaced from the continuous form, reducing the chance of heating the form.

Preferably, a first gap is formed between the pressure roller and the continuous form, and a second gap is formed between the heat roller and the continuous form, in response the continuous form being stopped along the feeding path by the drive mechanism. That is, a first gap is formed between the pressure roller and the continuous form, and a second gap is formed between the heat roller and the continuous form, in response to movement of the heat roller and the pressure roller away from each other by the separation mechanism. Air blown by the fans may enter into one or both of the gaps to directly cool the continuous form.

Preferably, the device includes a spacing mechanism for holding the continuous form out of contact with the heating roller and out of contact with the pressure roller. The spacing mechanism keeps the continuous form away from the heat and pressure rollers. The spacing means preferably includes a tensioning mechanism which maintains tension in the continuous form in response to the continuous form being stopped by the driving mechanism, in which case the continuous form is prevented from bowing, loosening, or otherwise coming into contact with the heat roller.

In one embodiment of the invention, the spacing mechanism includes a pair of rollers disposed downstream from the fixing mechanism along the feeding path. The pair of rollers nip the continuous form therebetween. A guide plate is disposed upstream of the fixing mechanism along the feeding path. The continuous form is thereby separated from the heat and pressure rollers between the rollers and guide form.

In a modification of the embodiment, the tensioning mechanism means includes a rotating mechanism which continuously rotates the pair of rollers in a downstream feeding direction. In a particularly preferred modification, the rotating means is rotated by the controller at a first speed when the drive mechanism drives the continuous form, and a second speed, slower than the first speed, when the drive mechanism stops the continuous form. That is, the rotating mechanism is rotated by the controller at a first speed when heat roller and pressure roller nip the continuous form therebetween, and a second speed, slower than the first speed, when the separation mechanism moves the heat roller and the pressure roller away from each other. Accordingly, the continuous form is kept under a steady tension by the rotation of the rollers (slipping on the form). Furthermore, the amount of tension is controlled as the rotating speed is reduced.

In another embodiment of the invention, the device includes a swingable pushing member between the fixing mechanism and the pair of rollers along the feeding path. The pushing member is swingable into the feeding path. The pushing member keeps the continuous form spaced away from the heat roller. Preferably, the spacing mechanism includes an operating member for swinging the pushing member into the feeding path in response to the continuous form being stopped by the drive mechanism, so that the pushing member pushes the continuous form away from the heat roller. That is, the spacing mechanism includes an operating mechanism for swinging the pushing member into the feeding path in response to movement of the heat roller and the pressure roller away from each other by the separation mechanism. In this case, the pushing member can be moved out of the feeding path when not required.

According to still another embodiment of the invention, a fan is arranged facing the pressure roller to blow air into the first gap between the pressure roller and the continuous form. In one variation, two fans are arranged to face the pressure roller at opposite ends of the pressure roller to blow air into the first gap between the pressure roller and the continuous form. In this manner, the fans or fans blow into the gap from the lower (pressure roller) side of the continuous form to cool the continuous form, while the continuous form acts as a shield to protect the heat roller from the cooling air flow generated by the fan or fans.

In yet another embodiment of the invention, a fan is arranged facing the heat roller, to blow air into the second gap between the heat roller and the continuous form. In this case, the fan or fans blow air onto the continuous form from the upper, printed (heat roller) side. In another particular case, two fans are arranged to face the heat roller at opposite ends of the heat roller to blow air into the second gap between the heat roller and the continuous form. Preferably, the device further includes a shielding mechanism provided between the heat roller and the fan or fans, for shielding the heat roller from air flow from the fan.

In one preferred embodiment, the shielding mechanism includes a duct leading from the fan to the continuous form. The duct or ducts preferably have a flattened outlet formed therein, extending in a width direction of the continuous form. The ducts confine and guide the air flow from the fan or fans directly to the continuous form, avoiding the heat roller.

In another preferred embodiment, a shield extends along the circumference of the heat roller between the heat roller and the fan. Preferably, the shield extends along the circumference of the heat roller between the heat roller and the continuous form. Further preferably, the shielding mechanism includes a moving mechanism for moving the shield between a first position extending along the circumference of the heat roller between the heat roller and the continuous form, and a second position where the shield is not interposed between the heat roller and the continuous form. In these embodiments, the shield can protect both the heat roller from the fan air flow and form from heat radiated from the heat roller, and is movable to allow proper fixing of a toner image.

Further preferably, the moving mechanism moves the shield in response to the continuous form being stopped by the drive mechanism. In this manner, the toner image is fixed when the continuous form is driven along the feeding path, but the continuous form is protected from the heat roller and the heat roller from the air flow when the continuous form is stopped. That is, the moving mechanism moves the shield in response to movement of the heat roller and the pressure roller away from each other by the separation means.

In yet still another embodiment, a first fan is arranged facing the pressure roller, to blow air into the first gap between the pressure roller and the continuous form. A second fan is arranged facing the heat roller, to blow air into the second gap between the heat roller and the continuous form. In this case, the fans blow air onto the continuous form from both top and bottom of the continuous form, enhancing the cooling effect.

DETAILED DESCRIPTION OF THE PREFERRED EMBODIMENTS

Figure 1:
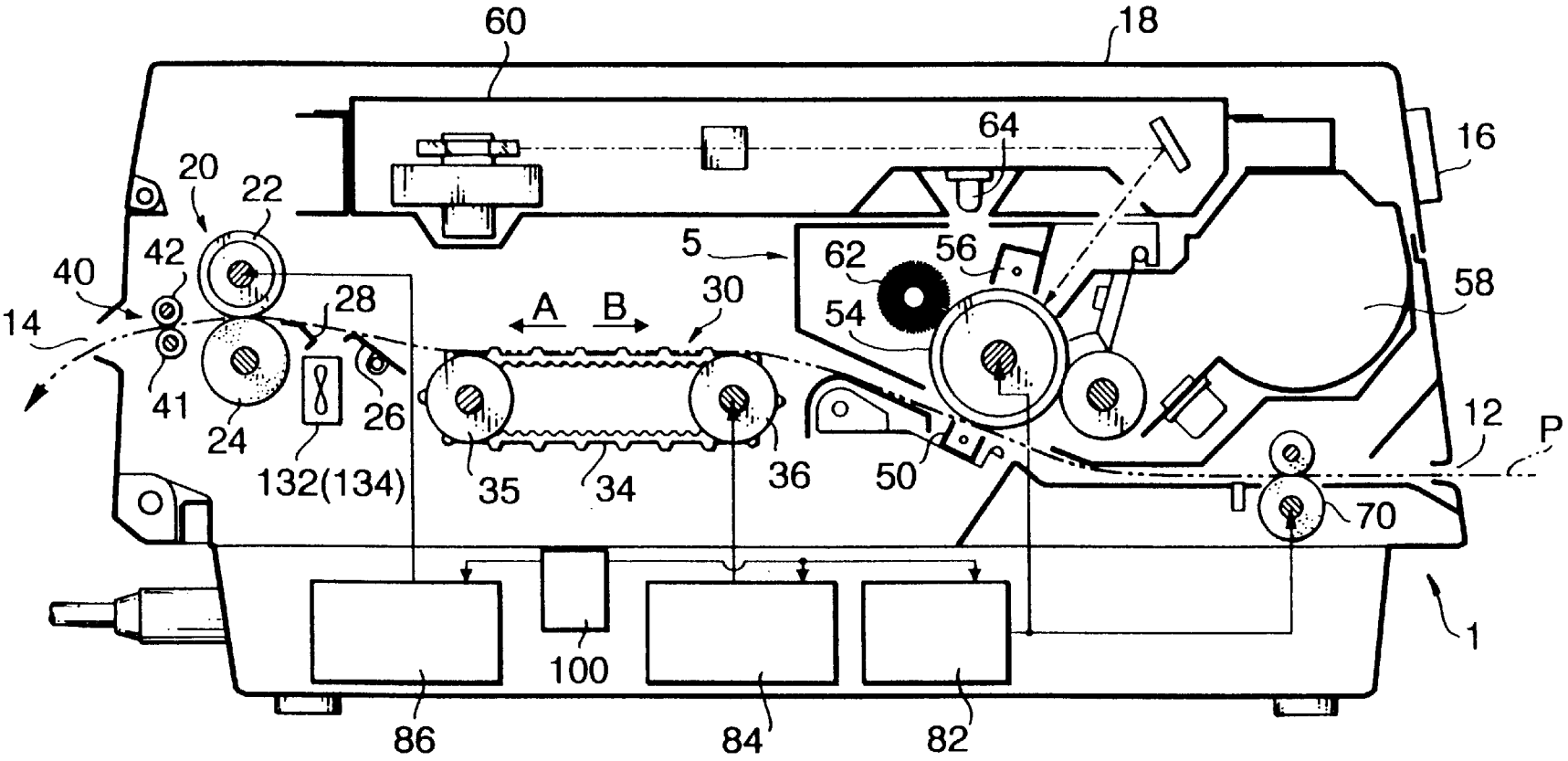
FIG. 1 shows a side schematic view of an electrophotographic printer, including a sheet drying prevention device according to the first embodiment of the invention.

FIG. 1 is a side schematic view showing an electrophotographic printer 1 according to an embodiment of the invention. A continuous form P, having feeding holes along both lateral sides of the form, and perforations for separating discrete pages of the form, is employed as a recording sheet in the electrophotographic printer 1. The continuous form P (shown by a double-dotted phantom line in FIG. 1) is transferred along a feeding path between a sheet inlet 12 and a sheet outlet 14.

The electrophotographic process is carried out by a process unit 5 including a photoconductive drum 54, a developing unit 58, a cleaning brush 62, a discharging lamp 64, and a charging station 56. Further, a transfer station 50; and a laser scanning unit 60 are associated with the process unit 5.

Positioned along the feeding path from the inlet 12 are the transfer station 50 for transferring a toner image onto the form P, a tractor unit 30 for regulating the feed of the form P, a fixing unit 20 for fusing the toner image onto the form P, and a discharge roller pair 40 for discharging the form P from the printer 1 are arranged in that order. The transfer of the image from the drum 54 to the form P takes place at the transfer station 50.

A back tension roller pair 70 is provided in the vicinity of the inlet 12 for applying tension to the form P. During feeding of the continuous form P, the back tension roller pair 70 always rotates to urge the form P in a reverse feeding direction, thereby maintaining tension. When the form P is fed in a forward direction, the back tension roller pair 70 slips on the surface of the continuous form P to apply a tension thereto. When the continuous form P is fed in the reverse feeding direction, the back tension roller pair 70 feeds the paper in cooperation with the tractor unit 30.

A laser beam modulated in accordance with an image signal is projected from the laser scanning unit 60 (scanning in a main scanning direction), and directed to the rotating (subscanning) photoconductive drum 54. The photoconductive drum 54 is driven at a constant speed via a gear train (not shown) by a motor 82. The photoconductive surface of the drum 54 is uniformly charged at the charging station 56. When the surface is exposed to the laser beam, a latent image is formed thereon. Toner is adhered to the latent image by a developing unit 58 to form a toner image. The toner image is transferred onto the recording sheet (form P) by discharging at the transfer station 50. The form bearing the toner image is fed downstream, and fixed by a fixing unit 20 to complete printing for that image.

Any toner remaining on the surface of the drum 54 (after transfer of the toner image to the form P) is removed by the cleaning brush 62. Furthermore, any remaining charge on the surface of the photoconductive drum 54 is discharged at the discharging lamp 64 in preparation for subsequent image formation.

The tractor unit 30 is provided with a front pulley 35, a drive pulley 36, and an endless tractor belt 34 (having tractor pins for engaging the feeding holes of the form P). A belt 34 and pulleys 35, 36 are provided on each lateral side of the feeding path. The drive pulley 36 is driven by a stepping motor 84 via a gear train (not shown), and is drivable in both forward (arrow A in FIG. 1) or reverse (arrow B in FIG. 1) directions. The motor 84 is a stepping motor, and is controlled to drive the tractor 30 at a constant speed in an open loop system.

The fixing unit 20 comprises a heat roller 22 and a pressure roller 24. The discharge roller pair 40 comprises an upper roller 42 and a lower roller 41. The heat roller 22 and lower discharge roller 41 are driven by a motor 86 via a gear train (not shown).

Figure 2:
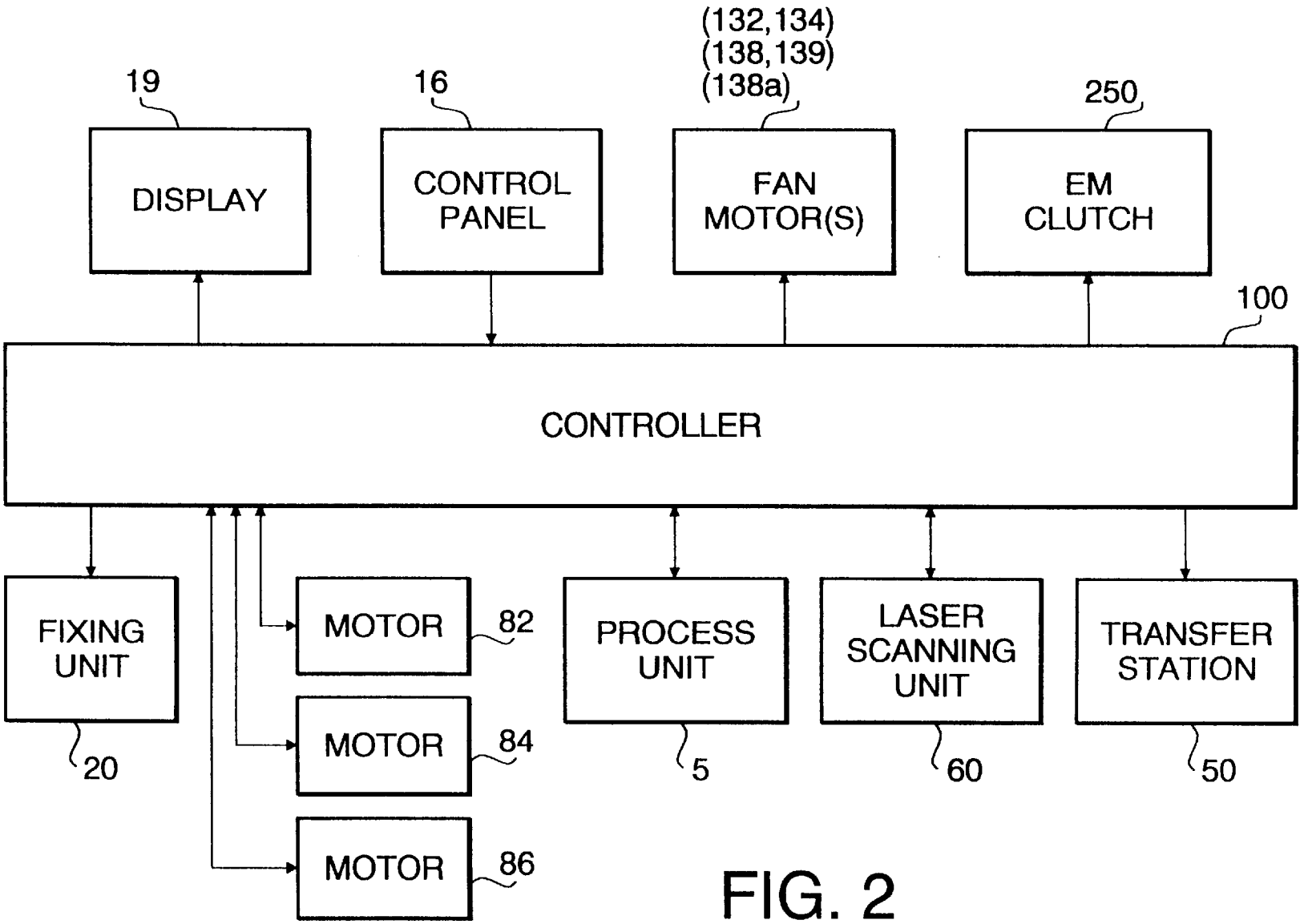
FIG. 2 shows a controller for the first and subsequent embodiments.

FIG. 2 shows a block diagram detailing the control system of the printer 1. Inputs to the controller 100 include a control panel 16 provided on the exterior of the printer 1. A display 19 can display error codes and other messages. The controller 100 controls motors 82, 84, and 86, an electromagnetic (EM) clutch 250, and fan motor(s) (132 and/or 134, 138, 139, 138*a*, depending on the embodiment, as described later). The controller also controls the fixing unit 20 (and thereby the discharge roller pair 40), and the transfer station 50 to move each between an operating position and a retracted position depending on the direction which paper is fed. Further, the controller 1 controls the elements of the electrophotographic process, including the laser scanning unit 60 and the process unit 5.

Figure 3A:
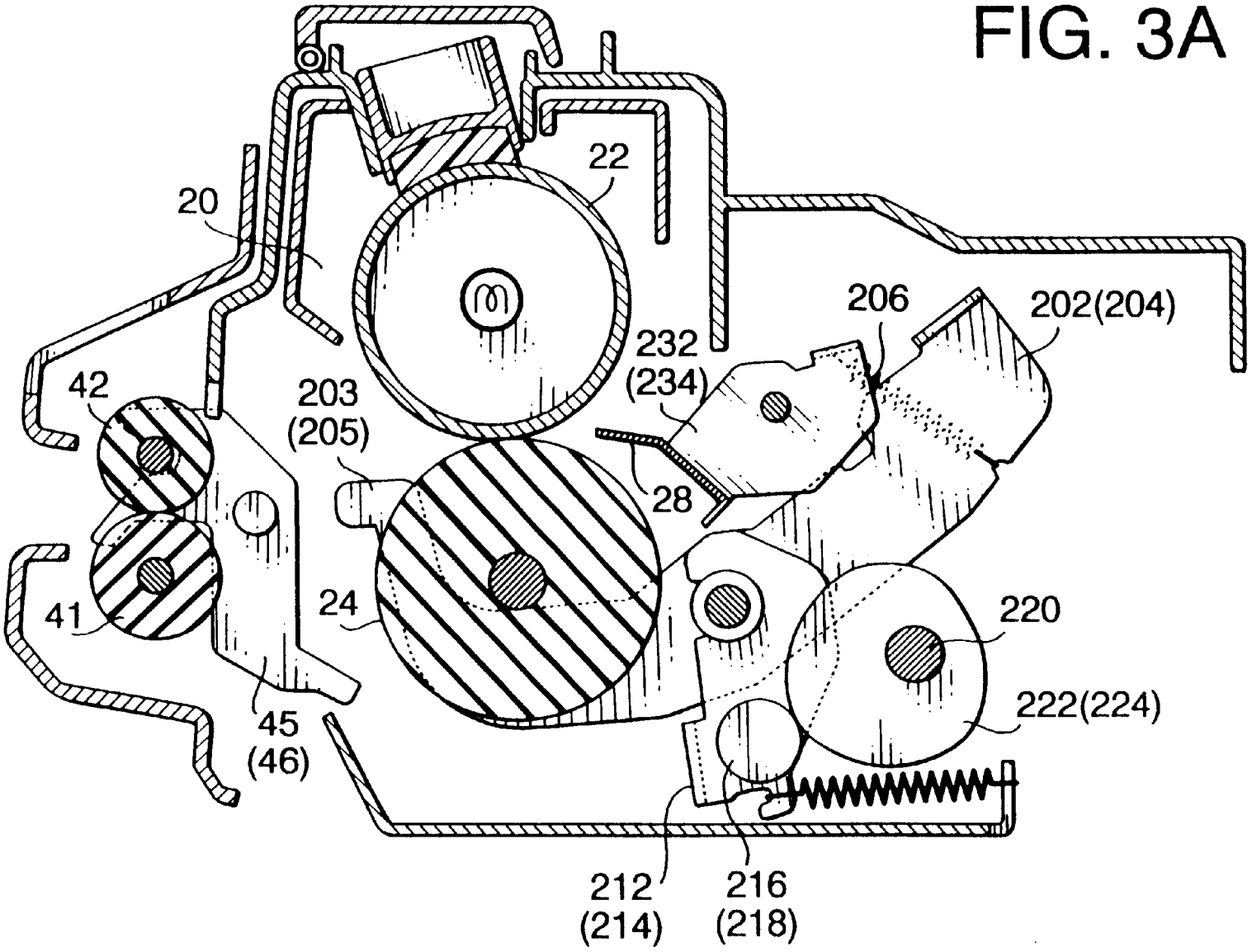
FIG. 3A is a side view of a fixing unit, showing an operating position of a roller retraction mechanism.
Figure 3B:
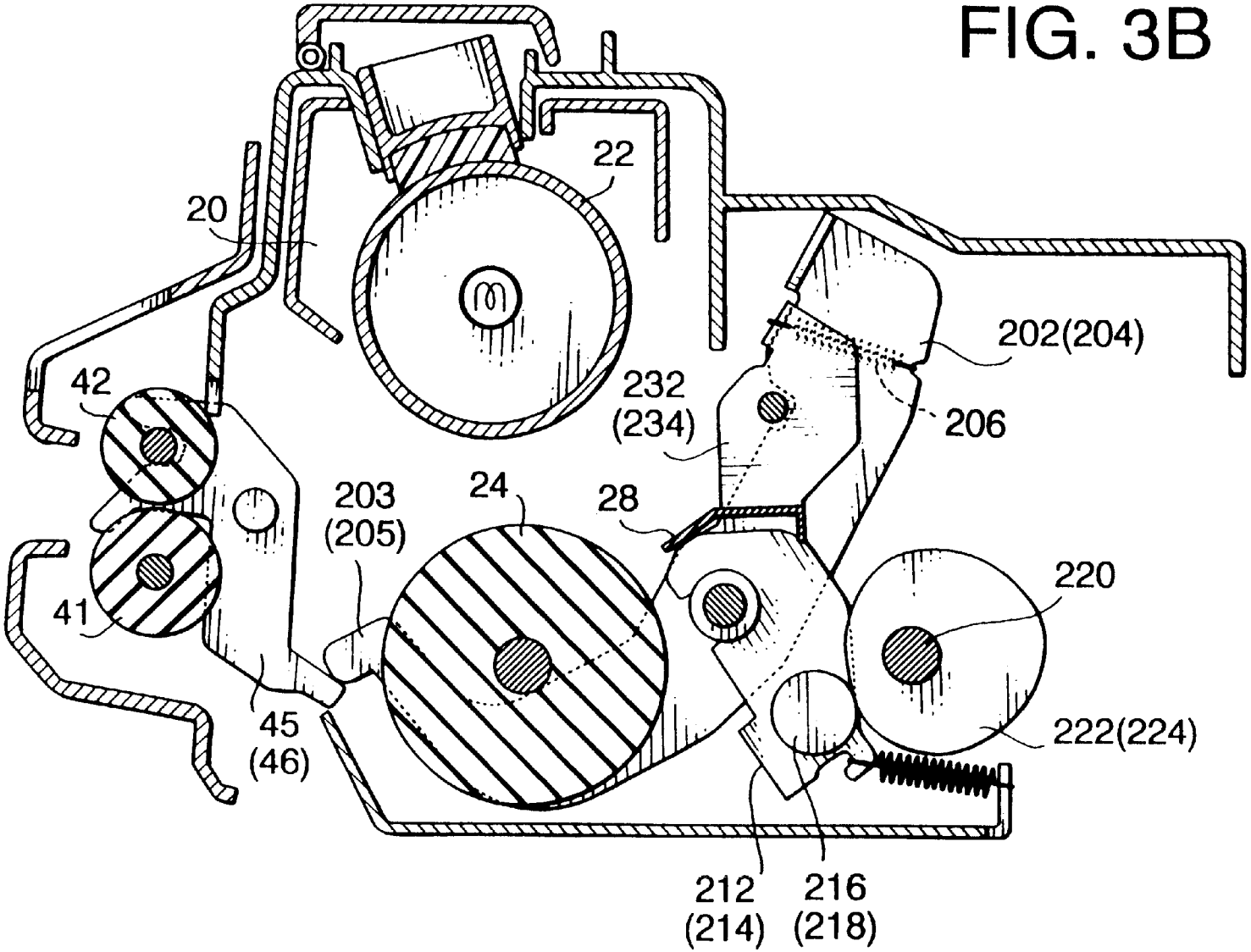
FIG. 3B is a side view of the fixing unit, showing a retracted position of a roller retraction mechanism.

FIGS. 3A and 3B show side views of the fixing unit 20, an area approximate thereto, and a roller retraction mechanism for retracting the pressure roller 24. In side views (FIGS. 3A, 3B, 4, 8, 9A, 10 and 11) elements distributed symmetrically on both lateral sides of the form feeding path are designated by a first numeral representing the left side (from the view point of the paper insertion end of the printer 1), followed by a second numeral in parenthesis designating the right side. As shown in FIG. 3A, both end portions of a pivot shaft of the pressure roller 24 are supported by a pair of pressure roller swing arms 202, 204. The pressure roller swing arms 202, 204 are swingable with respect to the body of the printer 1. Cam followers 216, 218 are secured, via a members 212, 214, to the pressure roller swing arms 202, 204, respectively. The cam followers 216, 218 are swingable about the same axis as the pressure roller swing arms 202, 204. The cam followers 216, 218 engage cams 222, 224, respectively. The cams 222 and 224 are mounted on a rotatably supported shaft 220. The shaft 220 is driven by the motor 86 via a gear train (not shown) when an electromagnetic clutch 250 (shown in FIG. 5) is engaged.

A pair of guide plate swing arms 232, 234 are swingably supported by the printer body above the pressure roller swing arms 202, 204. The guide plate swing arms 232, 234 respectively support either lateral side of a guide plate 28 extending across and below the sheet feeding path, and are coupled to the pressure roller swing arms 202, 204, respectively, via a spring 205. The guide plate 28 thereby swings together with the pressure roller swing arms 202, 204 to contact the lower side of a continuous form P in the fixing unit 20.

As shown in FIGS. 3A and 3B, the upper discharge roller 42 is swingably supported at either end by swingable discharge roller lift arms 45, 46. The discharge roller lift arms 45, 46 are actuated at an end opposite the upper discharge roller 42 by contact with end portions 203, 205 of the pressure roller swing arms 202, 204, respectively. When the pressure roller swing arms 202 and 204 swing down to move the pressure roller 24, the end portions 203, 205 press on the actuating end of the discharge roller lift arms 45, 46, respectively, lifting the discharge roller 42.

Thus, upon rotation of the cams 222, 224, the pressure roller swing arms 202,204, respectively, swing to move the pressure roller 24 between an operating position (shown in FIG. 3A) and a retracted position (shown in FIG. 3B). Furthermore, the guide plate swing arms 232, 234, and the discharge roller lift arms 45, 46 swing in response to the swinging movement of the pressure roller swing arms 202, 204 respectively. Accordingly, when the pressure roller 24 is moved in the direction of the retracted position, the position of the guide plate 28 (guiding the continuous form) is changed, and the upper discharge roller 42 is moved to a retracted position.

In the operating position, the pressure roller 24 presses the form P against the heat roller 22, and the upper discharge roller 42 presses the form P against the lower discharge roller 41. In the retracted position, the pressure roller 24 and upper discharge roller 42 are moved away from their respective facing rollers, and similarly away from contact with the form P.

Figure 4:
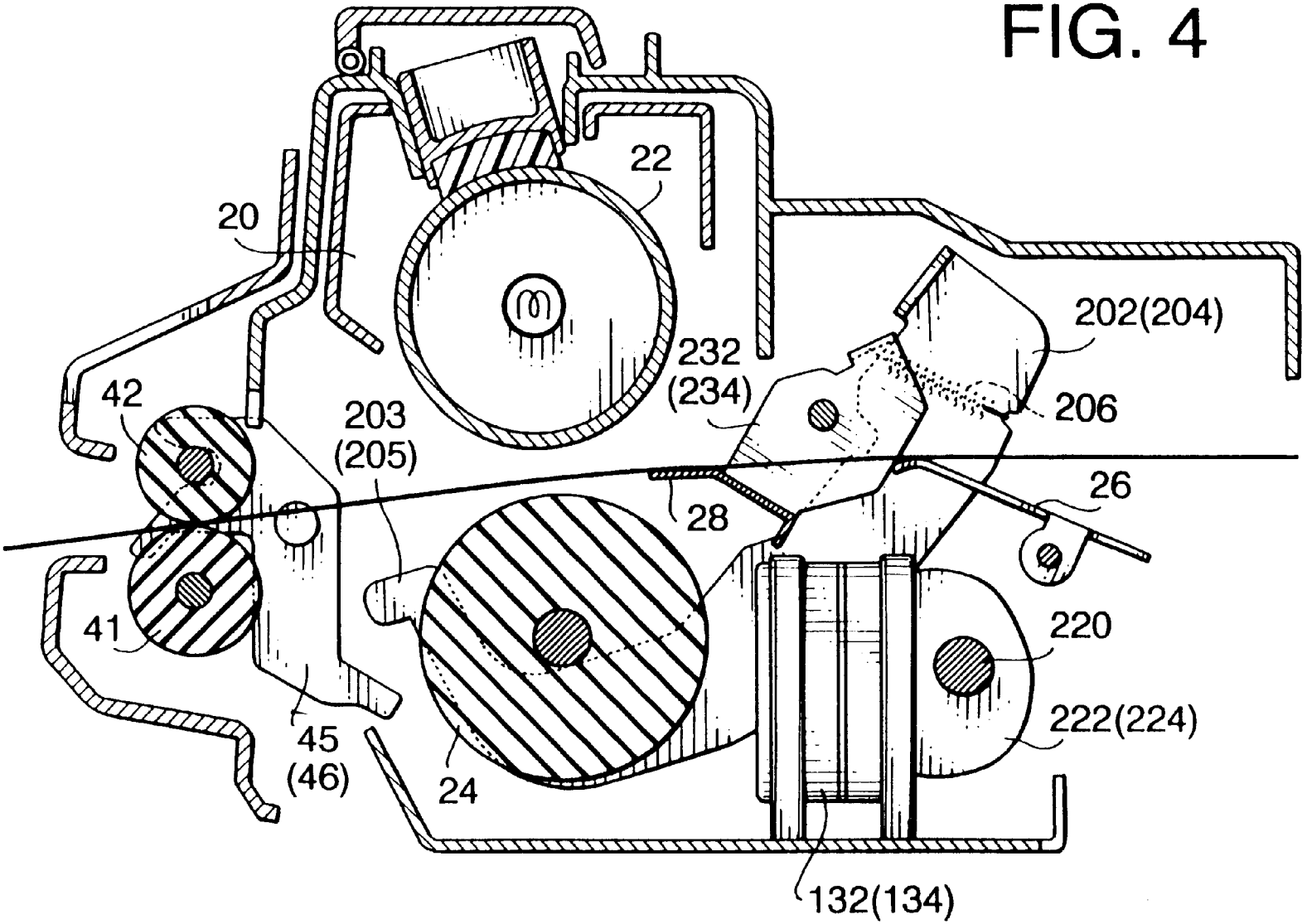
FIG. 4 is a side view of the fixing unit, showing an intermediate position of a roller retraction mechanism.

FIG. 4 shows an intermediate (MID in FIGS. 6D and 7D) position between the retracted position and the operating position of the pressure roller 24. In the intermediate position, the pressure roller 24 is moved away from the heat roller 22, but the discharge rollers 41, 42 of the discharge roller pair 40 still clamp the continuous form therebetween.

The motor 86 for driving the heat roller 22 and the lower discharge roller 41 is a stepping motor. During feeding, motor 86 drives the lower discharge roller 41 to feed the form P slightly faster (by a predetermined amount) than the tractor 30. As the tractor 30 and the form P are positively engaged while the tractor 30 is driven at a constant speed, the continuous form P is fed at a constant speed under a controlled tension.

As shown in FIGS. 1 and 4, a swingable speed control plate 26 contacts a lower surface of the continuous form P along the sheet feeding path between the tractor unit 30 and the fixing unit 20. The speed control plate 26 is biased upward by a spring (not shown). The inclination of the speed control plate 26 varies depending on the tension applied to the continuous form P. The inclination of the speed control plate 26 is detected by a sensor (not shown). The driving speed of the motor 86 is controlled so that the inclination of the speed control plate 26 is maintained in a predetermined range. That is, the motor 86 controls the driving speed of the heat roller 22 and the lower roller 41, so that the tension of the continuous form P between the tractor unit 30 and the fixing unit 20 always falls within a predetermined range.

In order to place a continuous form P into the printer 1, the continuous form P is led in through the inlet 12. The continuous form P is then clamped between the tractor belts 34 and corresponding tractor guide members (not shown) provided in the area of the tractor unit 30. The continuous form P is then advanced, fed only by the tractor 30. When the leading end of the continuous form P reaches the discharge roller pair 40, the continuous form P is nipped and pulled by the discharge roller pair 40, at a speed held constant by tractor 30.

The continuous form P is only fed (i.e., advanced or retracted) during printing. The heat roller 22 is kept at a high temperature to print as needed. The continuous form P remains between the fixing roller pair 20 when feeding stops. The portion of the continuous form P nipped therebetween is heated by the heat roller 22, and can become unusually dry or deformed. Since the printer 1 retracts the blank portions of the continuous form P into the printer for subsequent printing, a blank portion previously positioned in the vicinity of the fixing roller pair 20, and heated when in that position, may be used for a subsequent printing. If the form P is dry, the device will not print properly. Accordingly, as a first step, the pressure roller 24 is moved away from the heat roller 22 to prevent the heating and drying of the continuous form P.

Figure 5:
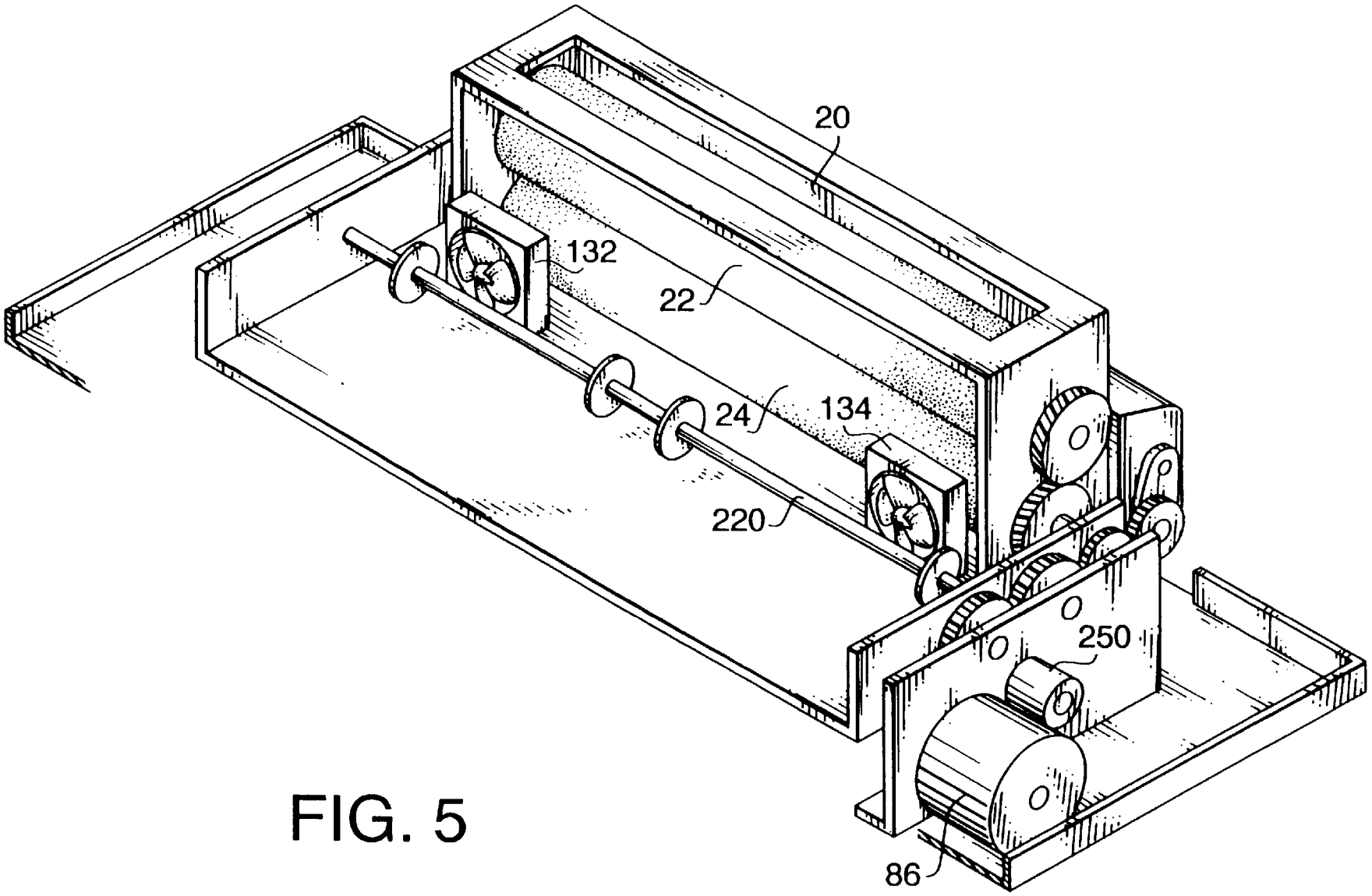
FIG. 5 is a rear perspective cutaway view of the fixing unit.

FIG. 4 is a side schematic view showing a first embodiment of a sheet drying and drying prevention mechanism, and FIG. 5 is a cutaway perspective view showing a fixing unit 20. In FIG. 4, the pressure roller 24 is positioned at an intermediate position between its operating position and retracted position. In this condition, the discharge roller pair 40 nips the continuous form P therebetween.

As shown in FIGS. 1, 4 and 5, beneath the continuous form feeding path, a fan or fans (in this case two fans, a first lower fan 132 and a second lower fan 134) is arranged at either end of the pressure roller 24, facing the pressure roller 24. It should be noted that although a pair of lower fans 132, 134 on either lateral side and below the continuous form P feed path is the preferred arrangement, the scope of the invention includes a single fan, or a plurality of fans, similarly arranged.

The lower fans 132 and 134 are driven by individual internal motors, or by a single motor for both. In this embodiment, when the feeding of the continuous form P stops, the lower fans 132 and 134 are driven to air cool the continuous form P. At this time, the pressure roller 24 is in an intermediate position as previously described, while the continuous form P is under tension between the discharge roller pair 40 and the guide plate 28.

The area cooled by the lower fans 132, 134 includes the space between the lower surface of the continuous form P and the top of the pressure roller 24, thereby cooling. Accordingly, the continuous form P is cooled. Since a predetermined tension is applied to the continuous form P by the discharge roller pair 40, the continuous form P does not move when the air flow generated by lower fans 132 and 134. Thus, the continuous form P stays out of contact with the heat roller 22 or the pressure roller 24. Further, the continuous form P blocks the air flow path between the lower fans 132, 134, so that the heat roller 22 is not cooled by the lower fans 132, 134. Accordingly, the high temperature of the heat roller 22 is maintained at all times for properly fusing the toner image, even though the continuous form P is cooled.

Figures 6A, 6B, 6C, 6D, 6E, 6F:
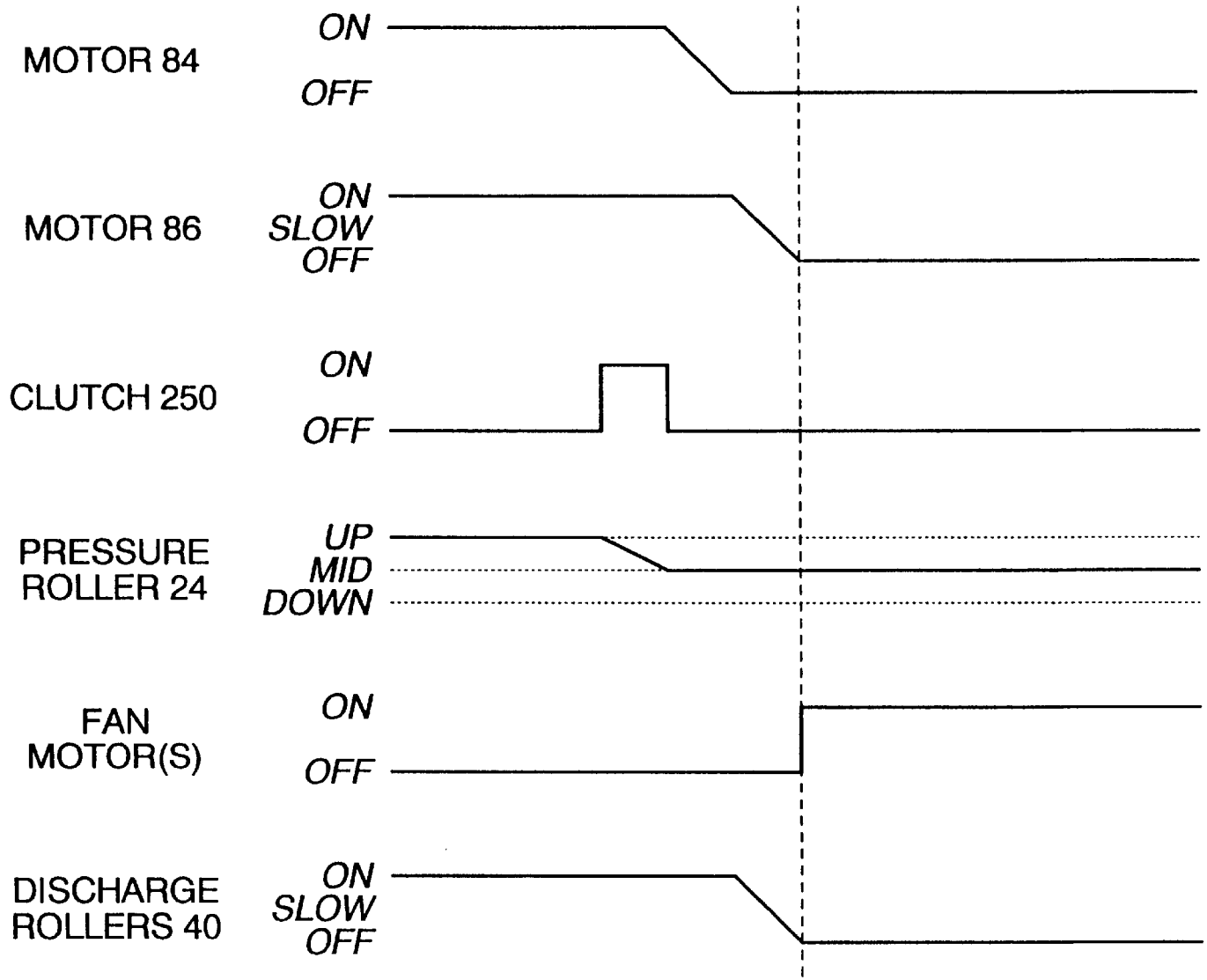
FIG. 6A shows timing for a motor that drives a tractor in the first embodiment.
FIG. 6B shows timing for a motor that rotates a heat roller and lower discharge roller in the first embodiment.
FIG. 6C shows timing for an electromagnetic clutch in the first embodiment.
FIG. 6D shows the position of a pressure roller in the first embodiment.
FIG. 6E shows the driving of the fan motor(s) in the first embodiment.
FIG. 6F shows the driving of a discharge roller pair in the first embodiment.

FIGS. 6A through 6F show the operation timing of the roller retraction mechanism 200 and associated parts just after printing. FIG. 6A shows timing for the motor 84, which drives the tractor 30 when ON; FIG. 6B shows timing for the motor 86, which rotates the heat roller 22 and lower discharge roller 41 when ON; FIG. 6C shows timing for the electromagnetic clutch 250, which engages the roller retraction mechanism when ON to move the pressure roller 24 and upper discharge roller 42; FIG. 6D shows the position of the pressure roller; and FIG. 6E shows timing for the fan motor (in this case, for the fans 132 and 134). FIG. 6F shows the driving of the discharge roller pair 40, which is stopped at the same time as the motor 86.

As shown in FIGS. 6A through 6F, upon completion of the printing operation, the controller 100 engages the electromagnetic clutch and brings the pressure roller 24, the guide plate 28, and the upper discharge roller 42 to the position shown in FIG. 4. Subsequently, the control unit 100 stops the motor 84 (thus stopping the tractor 30), followed shortly thereafter by the motor 86 (stopping the fixing roller pair 20 and discharge roller pair 40).

At this point, a printed and fixed portion has been discharged from the printer 1. Since the discharge roller pair 40 continues for a brief time after the tractor 30 is stopped, tension is created between the guide plate 28 and the discharge roller pair 40.

At this time (at the point indicated by the dashed line connecting FIGS. 6A through 6F) the lower fans 132, 134 are started. The lower fans 132, 134 blow on the continuous form P from the pressure roller 22 side, cooling the continuous form P and preventing the continuous form P from drying and/or deforming.

Figures 7A, 7B, 7C, 7D, 7E, 7F:
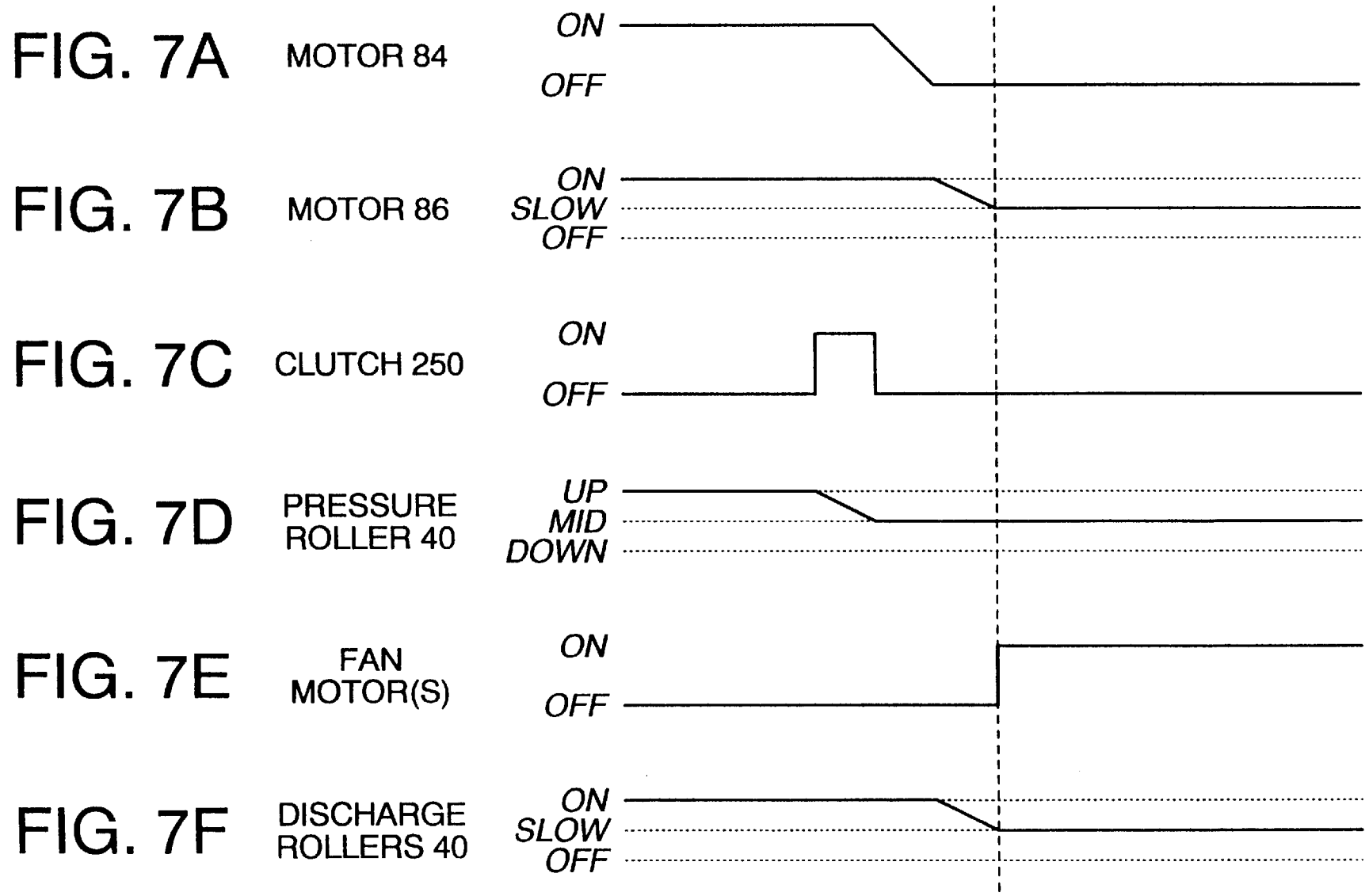
FIG. 7A shows timing for a motor that drives a tractor in a modification of the first embodiment.
FIG. 7B shows timing for a motor that rotates a heat roller and lower discharge roller in the modification of the first embodiment.
FIG. 7C shows timing for an electromagnetic clutch in the modification of the first embodiment.
FIG. 7D shows the position of a pressure roller in the modification of the first embodiment.
FIG. 7E shows the driving of the fan motor(s) in the modification of the first embodiment.
FIG. 7F shows the driving of a discharge roller pair in the modification of the first embodiment.

FIGS. 7A through 7F show the operation timing of the roller retraction mechanism 200 and associated parts, according to a modification of the first embodiment of the invention. FIG. 7A shows timing for the motor 84, which drives the tractor 30 when ON; FIG. 7B shows timing for the motor 86, which rotates the heat roller 22 and lower discharge roller 41 when ON; FIG. 7C shows timing for the electromagnetic clutch 250, which engages the roller retraction mechanism when ON to move the pressure roller 24 and upper discharge roller 42; FIG. 7D shows the position of the pressure roller; and FIG. 7E shows timing for the fan motor (in this case, for the fans 132 and 134). FIG. 7F shows the driving of the discharge roller pair 40, which rotate according to the timing of the motor 86.

As shown in FIG. 7B, after the continuous form P is stopped, the discharge roller pair 40 nips the continuous form P, and continues to rotate. Tension is thus steadily applied to the continuous form P, so that the form P is prevented from loosening in the air flow from the lower fans 132, 134. In a particularly favorable development of this modification of the first embodiment, the rotational speed of motor 86 and the lower roller 41 (the driving roller of the discharge roller pair 40) is decreased, to provide a reduced, but steady, tension to the continuous form P.

Figure 8:
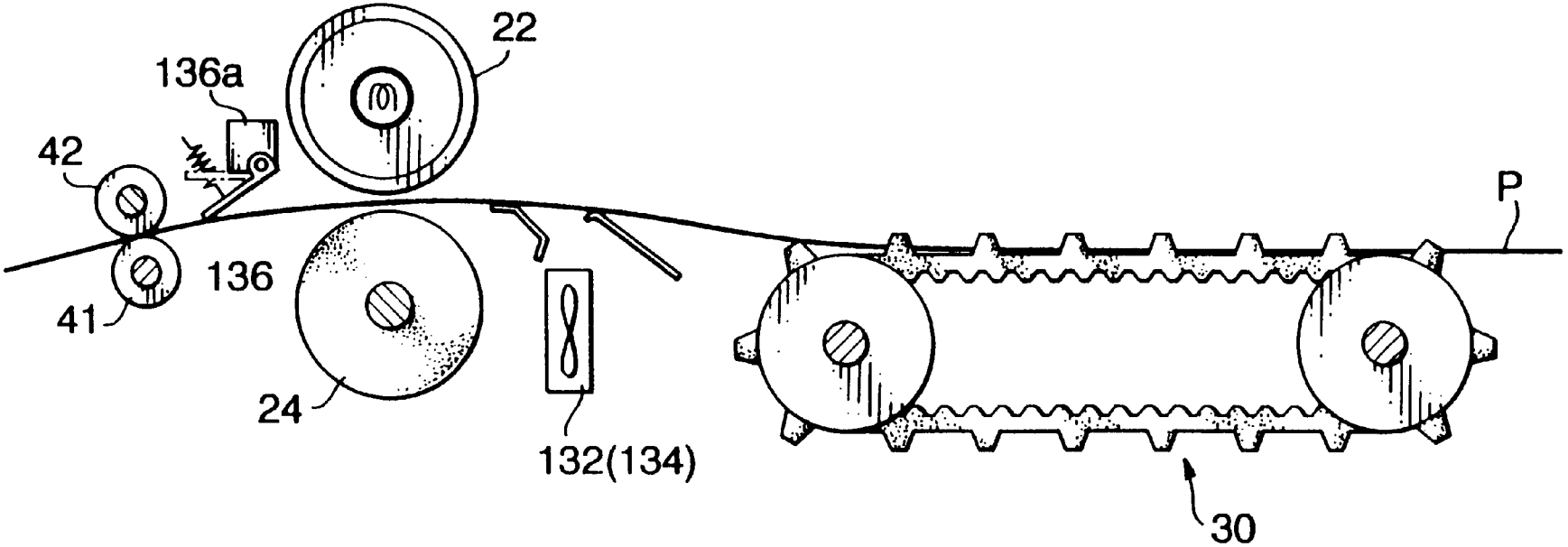
FIG. 8 shows a side schematic view of elements of a third embodiment of the sheet drying prevention device.

FIG. 8 shows a second embodiment of a sheet drying prevention device according to the present invention. As shown in FIG. 8, a swinging plate 136 is provided along the sheet feeding path between the heat roller pair 20 and the discharge roller pair 40. This swinging plate 136 can be moved between an operating position and a retracted position by a moving mechanism 136*a*. In the operating position (shown by a solid line in FIG. 8), the swinging plate 136 intrudes into the feeding path of the continuous form P, while in the retracted position (shown by a phantom line in FIG. 8), the swinging plate 136 is moved away from the feeding path. The swinging plate 136 is moved to its operating position only when the lower fans 132, 134 are operated. During printing, it is retracted to its retracted position. When the swinging plate 136 is in its operating position, it abuts the continuous form P on the printed side (the top side) to prevent the continuous form P from shifting from the feeding path. By placing the swinging plate 136 into the continuous form P feed path, as the lower fans 132, 134 are driven, it prevents any bowing or loosening of the form P in the direction of the heat roller 22.

Figure 9A:
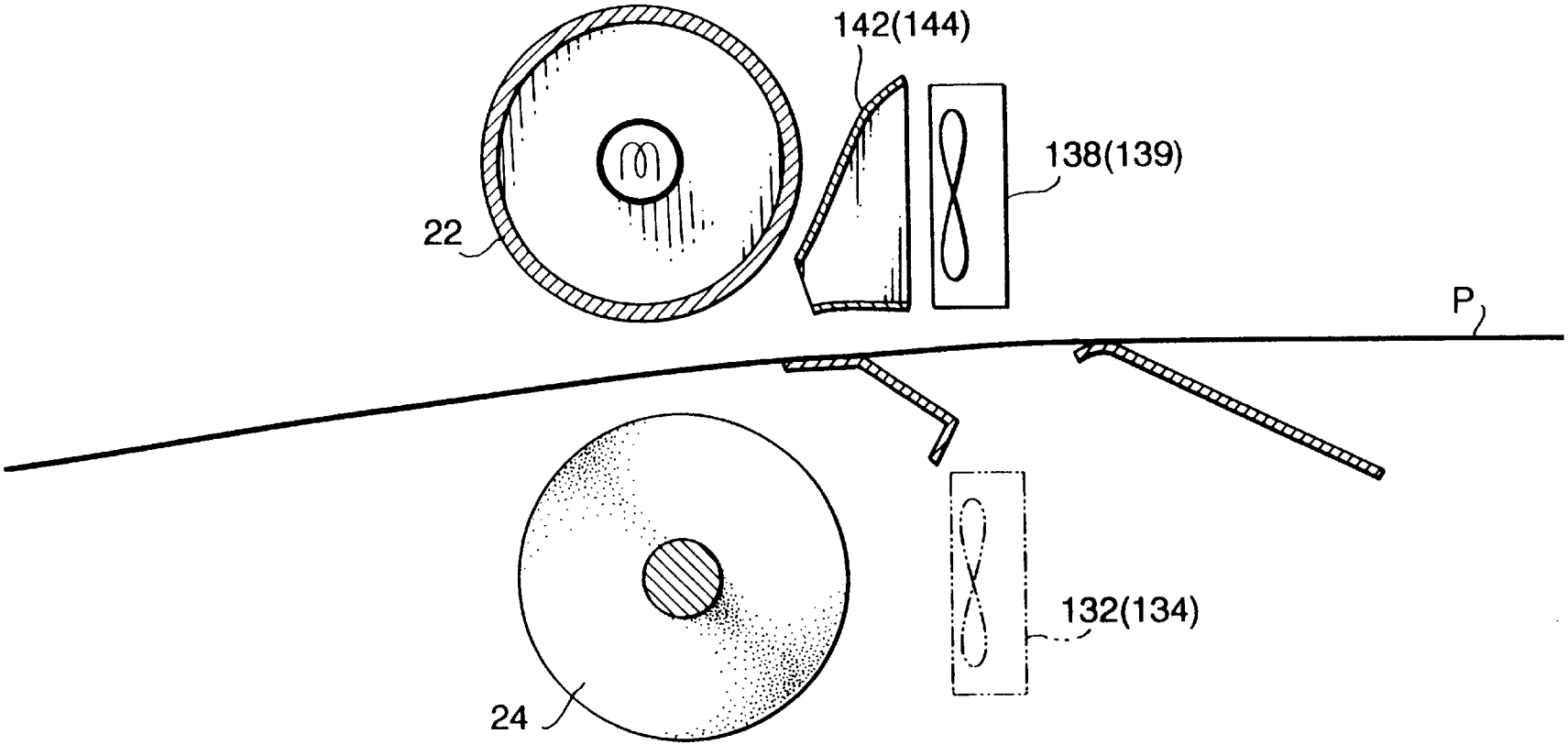
FIG. 9A shows a side schematic view of elements of a third embodiment of the sheet drying prevention device.
Figure 9B:
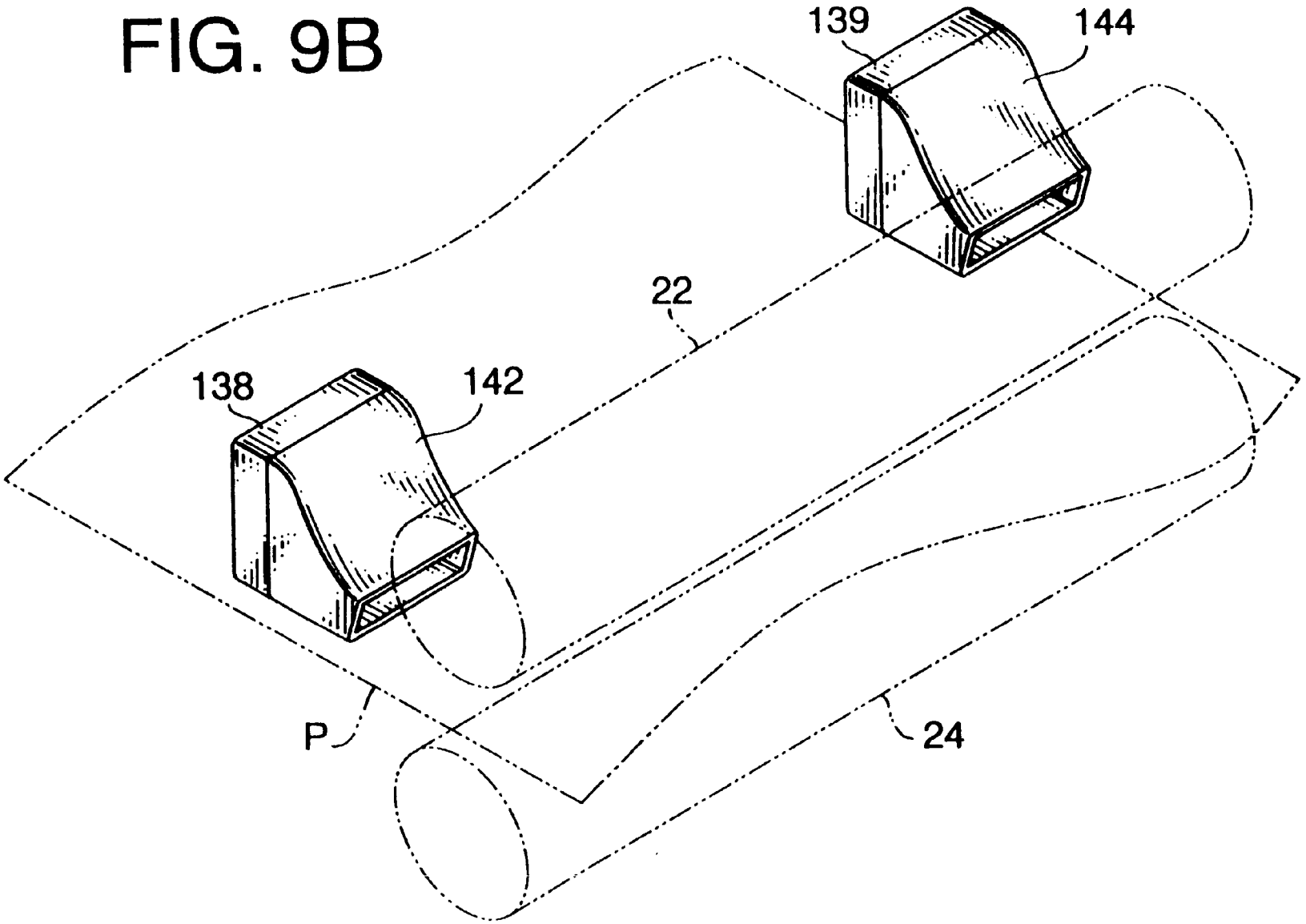
FIG. 9B is a perspective view of a first arrangement of fans and ducts according to the third embodiment of the sheet drying prevention device.
Figure 9C:
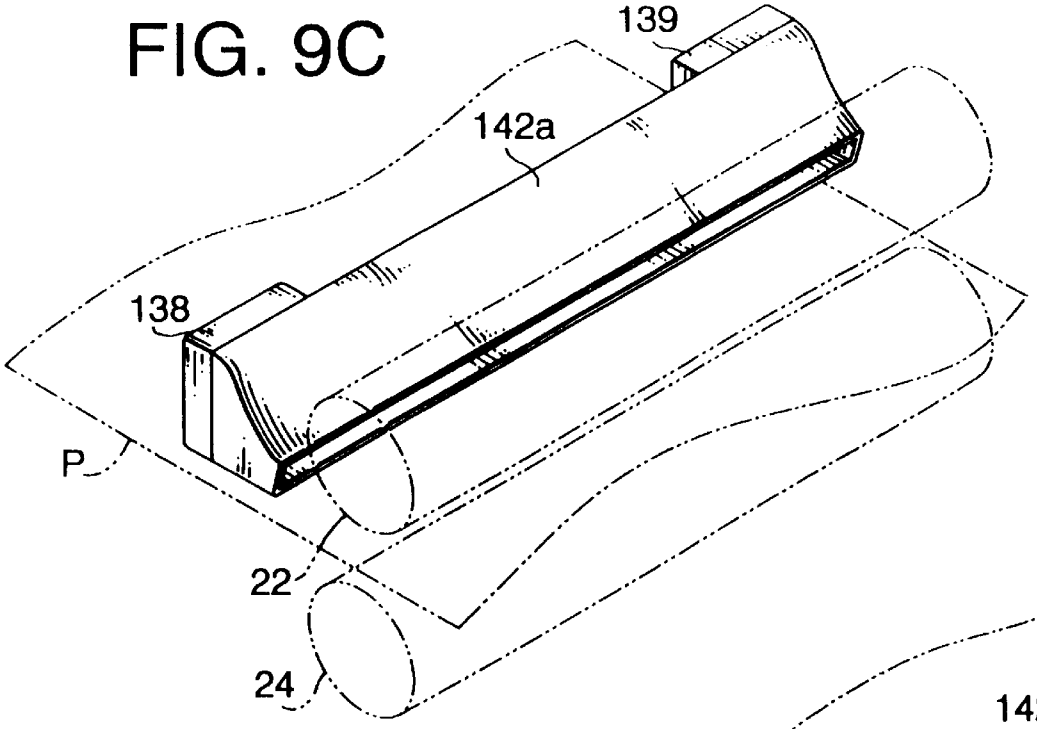
FIG. 9C is a perspective view of a second arrangement of fans and ducts according to the third embodiment of the sheet drying prevention device.
Figure 9D:
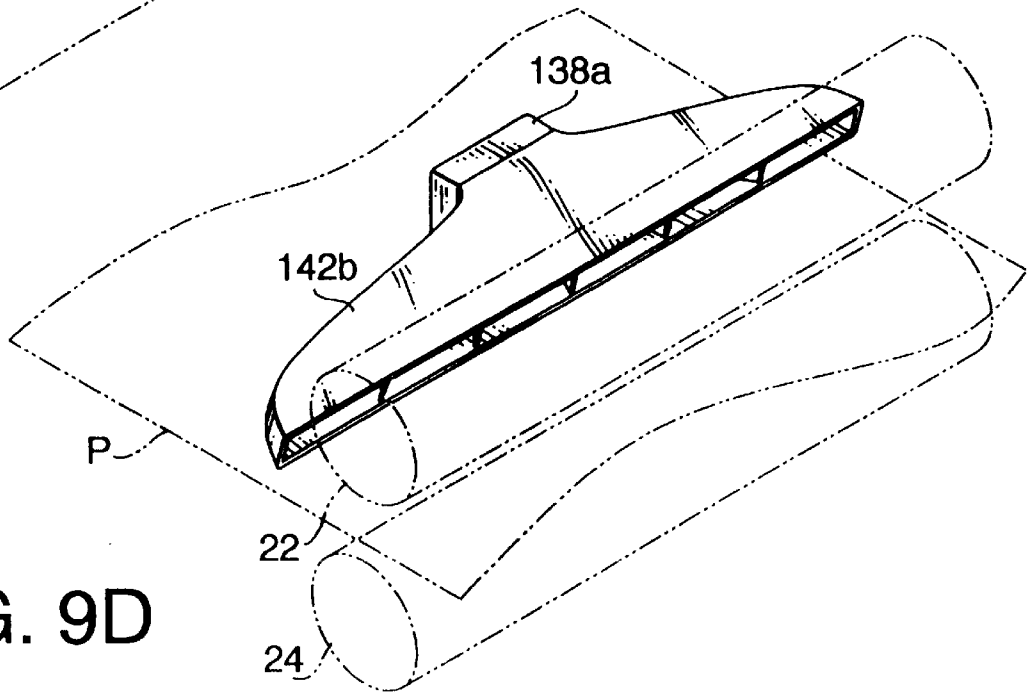
FIG. 9D is a perspective view of a second arrangement of fans and ducts according to the third embodiment of the sheet drying prevention device.

FIGS. 9A through 9D show a third embodiment of a sheet drying prevention device according to the present invention. FIG. 9A shows a side schematic view of the third, embodiment, while FIGS. 9B through 9D show perspective views of various ducts employable with the third embodiment of the invention. As shown in FIG. 9A, upper fans 138 and 139 are provided on the heat roller side of the continuous form P. Ducts 142 and 144 are provided between the heat roller 22 and the upper fans 138 and 139, respectively. It should be noted that although a pair of upper fans 138, 139 and a pair of ducts 142, 144 on either lateral side and above the continuous form P feed path is the preferred arrangement, the scope of the invention includes a single fan and duct, or a plurality of fans and ducts, similarly arranged.

The air flow from the upper fans 138, 139 is confined and led to the top (printed) surface of the continuous form P by the ducts 142 and 144. Thus, the heat roller 22 is shielded (and therefore remains hot) from the air flow from the fans 138, 139, even though the continuous form P is cooled by the air confined and led from the fans 138, 139. As shown in FIGS. 9A through 9D, the outlets of the ducts are flat in the width direction of the continuous form P so that the air can be blown over the entire width of the continuous form P.

In FIGS. 9B, 9C, and 9D, the heat roller 22, the pressure roller 34, and the continuous form P are represented by phantom lines to show alternative arrangements of the ducts and upper fans. FIG. 9B shows a first arrangement of the third embodiment wherein two fans 138, 139, are provided with individual ducts 142, 144, respectively that confine and lead the air flow from the fans 138, 139 to the top (printed) surface of the continuous form P. FIG. 9C shows a second arrangement of the third embodiment wherein two fans 138, 139, are provided with a single shared duct 142*a*, that combines, confines and leads the air flow from the fans 138, 139 to the top (printed) surface of the continuous form P; the air flow is distributed over the width of the continuous form P. FIG. 9D shows a third arrangement of the third embodiment wherein a single fan 138*a* is provided with a single flaring duct 142*b*, that distributes, confines and leads the air flow from the fan 138*a* to the top (printed) surface of the continuous form P, the air flow being distributed over the width of the continuous form P.

In this embodiment, although the upper fans 138, 139 are provided instead of the lower fans 132, 134, a further modification of the third embodiment is shown in FIG. 9A, where the lower fans 132, 134 (below the continuous form P feeding path and facing the pressure roller 24) are represented by phantom lines. In this case, the lower fans 132, 134 are provided in addition to the upper fans 142, 144, such that the air flow from both upper and lower fans is directed onto the continuous form P. The lower fans 132 and 134 are arranged at positions substantially symmetrical to the upper fans 138 and 139 about the continuous form P.

Figure 10:
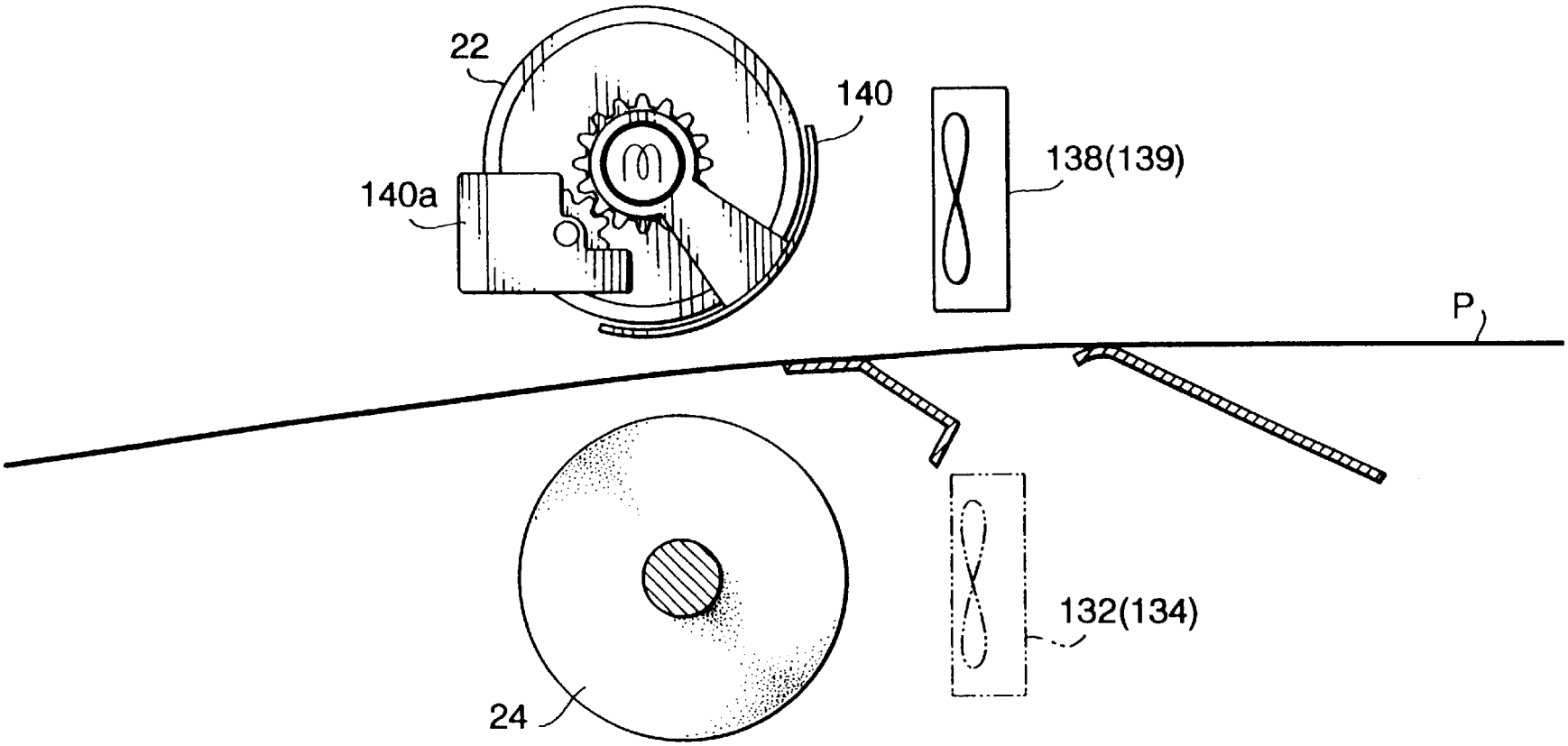
FIG. 10 shows a side schematic view of elements of a fourth embodiment of the sheet drying prevention device.

FIG. 10 shows a side schematic view of a fourth embodiment of a sheet drying prevention device according to the present invention. As shown in FIG. 10, upper fans 138 and 139 are provided at the heat roller 22 side of the continuous form P. Further, a shutter 140, movable by a driving mechanism 140*a*, is provided to shield the heat roller 22 from the upper fans 138, 139, and to shield the continuous form P from the heat roller 22. The shutter 140 prevents air flow from the fans 138 and 139 to the heat roller 22 to prevent the heat roller 22 from being cooled. At the same time, the shutter 140 decreases the amount of heat radiating from the heat roller 22 to the continuous form P. Thus, the continuous form P is protected from direct heat radiation from the heat roller 22, while being cooled by the air flow from the upper fans 138, 139. This prevents heating, drying, or deformation of the continuous form P.

In this embodiment, although the upper fans 138, 139 are provided instead of the lower fans 132, 134, a further modification of the fourth embodiment is shown in FIG. 10, where the lower fans 132, 134 (below the continuous form P feeding path and facing the pressure roller 24) are represented by phantom lines. In this case, the lower fans 132, 134 are provided in addition to the upper fans 142, 144, such that the air flow from both upper and lower fans is directed onto the continuous form P. The lower fans 132 and 134 are arranged at positions substantially symmetric to the upper fans 138 and 139 about the continuous form P.

Figure 11:
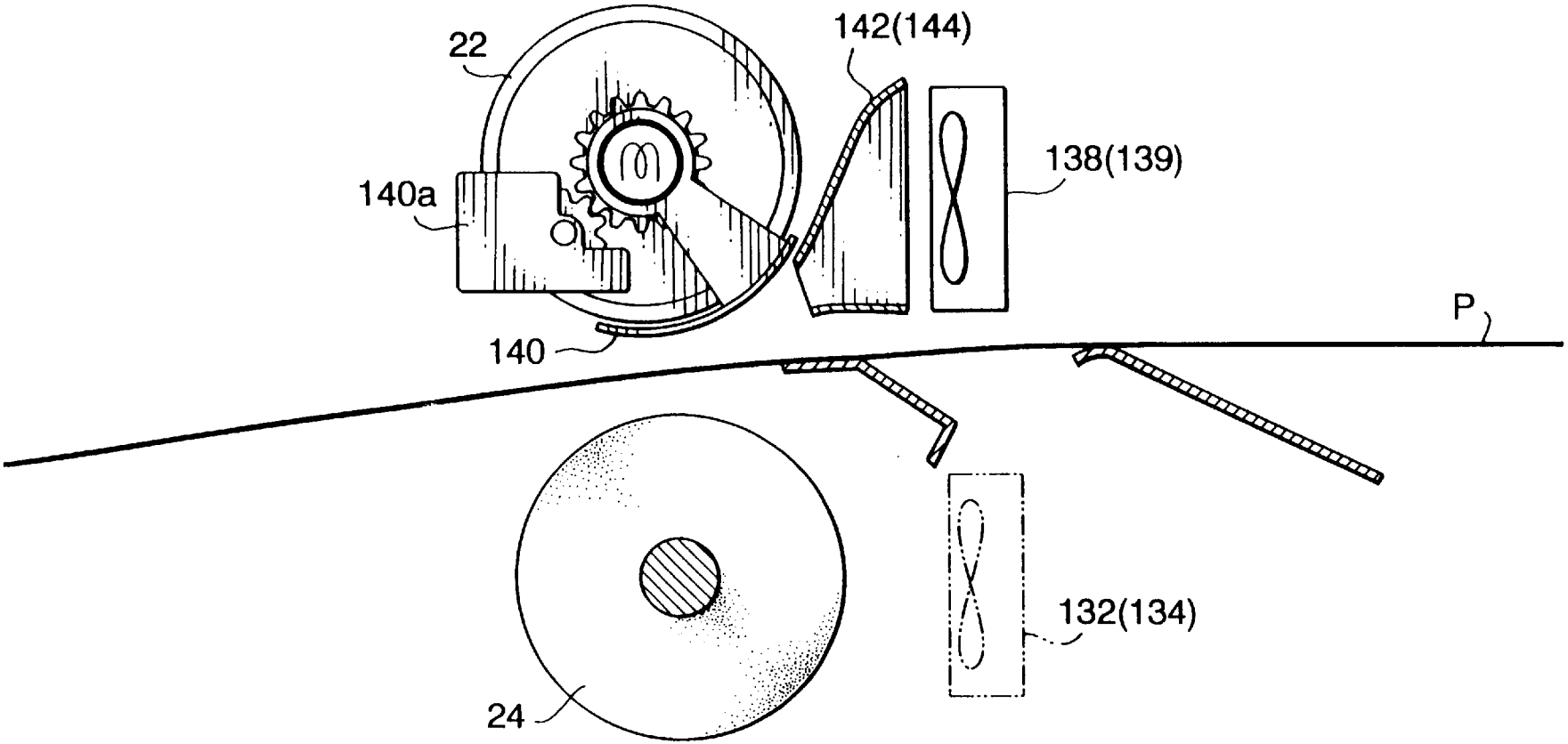
FIG. 11 shows a side schematic view of elements of a fifth embodiment of the sheet drying prevention device.

FIG. 11 shows a side schematic view of a fifth embodiment of a sheet drying prevention device according to the present invention. As shown in FIG. 11, similar to the fourth embodiment, the shutter 140 shields the heat roller 20 from the fans 138 and 139, and shields the continuous form P from the heat roller 20. Furthermore, similar to the third embodiment, the ducts 142 and 144 are provided at the outlets of the fans 138, 139 on the heat roller side of the continuous form P. It thereby shields heat radiating from the heat roller 22 toward the continuous form P, and prevents cooling of the heat roller 22 from cooling due to the air from the fans 138 and 139, and cools the continuous form P with the air flow confined and led from the upper fans 138, 139 by the ducts 142, 144. It should be noted that the fifth embodiment can be provided, among other arrangements, with any of the fan and duct arrangements of FIGS. 9B through 9D.

In this embodiment, although the upper fans 138, 139 are provided instead of the lower fans 132, 134, a further modification of the fifth embodiment is shown in FIG. 11, where the lower fans 132, 134 (below the continuous form P feeding path and facing the pressure roller 24) are represented by phantom lines. In this case, the lower fans 132, 134 are provided in addition to the upper fans 142, 144, such that the air flow from both upper and lower fans is directed onto the continuous form P. The lower fans 132 and 134 are arranged at positions substantially symmetrical to the upper fans 138 and 139 about the continuous form P.

Thus, according to the embodiments of the invention, a continuous form stopped in the fixing unit (when the printer is not printing) can be effectively cooled, to prevent, drying or deformation due to exposure to heat. At the same time, the heat roller is protected from cooling air flow, and can maintain a high temperature.

What is claimed is:

1. A sheet drying prevention device for an electrophotographic printer employing a continuous form, said sheet drying prevention device comprising:

imaging means for forming a toner image on the continuous form;

fixing means for fixing said toner image onto the continuous form, said fixing means including a pressure roller and a heat roller between which the continuous form passes;

drive means for driving and stopping the continuous form along a feeding path from said imaging means to said fixing means;

separating means for selectively moving said heat roller and said pressure roller away from each other, and for moving said heat roller and said pressure roller together to nip the continuous form therebetween;

at least one fan for blowing air onto the continuous form in the vicinity of the fixing means;

a controller for controlling said separating means and said at least one fan, said controller moving said heat roller and said pressure roller away from each other, and starting said at least one fan, in response to the continuous form being stopped along the feeding path by said drive means;

a pair of rollers disposed downstream of said fixing means alone the feeding path, said pair of rollers nipping the continuous form therebetween;

rotating means for continuously rotating said pair of rollers in a downstream feeding direction, said rotating means maintaining tension in said continuous form when said continuous form stops moving; and a shield extending along a circumference of said heat roller, disposed between said heat roller and said at least one fan, effective to shield said heat roller from air flow from said at least one fan.

2. The sheet drying prevention device according to claim 1, wherein said separating means moves the continuous form away from said heat roller in response to the continuous form being stopped along the feeding path by said drive means.

3. The sheet drying prevention device according to claim 2, wherein a first gap is formed between said pressure roller and the continuous form, and a second gap is formed between said heat roller and the continuous form, in response to the continuous form being stopped along the feeding path by said drive means.

4. The sheet drying prevention device according to claim 3, wherein said pair of rollers hold the continuous form out of contact with said heat roller and said pressure roller.

5. The sheet drying prevention device according to claim 4, further comprising:

a guide plate disposed upstream of said fixing means along the feeding path.

6. The sheet drying prevention device according to claim 1, wherein said pair of rollers is rotated by said controller at a first speed when said drive means drives the continuous form, and a second speed which is slower than said first speed, when said drive means stops the continuous form.

7. The sheet drying prevention device according to claim 4, further comprising:

a swingable pushing member disposed between said fixing means and a pair of rollers along the feeding path, said pushing member being swingable into the feeding path.

8. The sheet drying prevention device according to claim 7, further comprising:

operating means for swinging said pushing member into the feeding path in response to the continuous form being stopped by said drive means, so that said pushing member pushes the continuous form away from said heat roller.

9. The sheet drying prevention device according to claim 3, said at least one fan comprising:

a fan arranged to face said pressure roller, for blowing air into said first gap between said pressure roller and the continuous form.

10. The sheet drying prevention device according to claim 9, said at least one fan comprising:

two fans arranged facing said pressure roller, each of said two fans being disposed at opposite ends of said pressure roller, for blowing air into said first gap between said pressure roller and the continuous form.

11. The sheet drying prevention device according to claim 3, said at least one fan comprising:

a fan arranged facing said heat roller, for blowing air into said second gap between said heat roller and the continuous form.

12. The sheet drying prevention device according to claim 3, said fan comprising:

two fans arranged facing said heat roller at opposite ends of said heat roller, for blowing air into said second gap between said heat roller and the continuous form.

13. The sheet drying prevention device according to claim 1, wherein said shield extends along the circumference of said heat roller between said heat roller and the continuous form.

14. The sheet drying prevention device according to claim 13, further comprising:

moving means for moving said shield between a first position extending along the circumference of said heat roller between said heat roller and the continuous form and a second position where said shield is not interposed between said heat roller and the continuous form.

15. The sheet drying prevention device according to claim 14, wherein said moving means moves said shield in response to the continuous form being stopped by said drive means.

16. The sheet drying prevention device according to claim 3, said at least one fan comprising:

a first fan arranged to face said pressure roller for blowing air into said first gap between said pressure roller and the continuous form, and a second fan arranged to face said heat roller for blowing air into said second gap between said heat roller and the continuous form.

17. The sheet drying prevention device according to claim 11, said fan comprising:

two fans arranged facing said heat roller at opposite ends of said heat roller, for blowing air into said second gap between said heat roller and the continuous form.

18. The sheet drying prevention device according to claim 11, said shield extends along the circumference of said heat roller between said heat roller and said at least one fan.

19. The sheet drying prevention device according to claim 18, wherein said shield extends along the circumference of said heat roller between said heat roller and the continuous form.

20. The sheet drying prevention device according to claim 19, further comprising:

moving means for moving said shield between a first position extending along the circumference of said heat roller between said heat roller and the continuous form and a second position where said shield is not interposed between said heat roller and the continuous form.

21. The sheet drying prevention device according to claim 20, wherein said moving means moves said shield in response to the moving of said heat roller and said pressure roller away from each other by said separation means.

22. A sheet drying prevention device for a continuous form electrophotographic printer, said sheet drying prevention device comprising:

a feeding path along which the continuous form is moved and stopped;

fixing means for fixing a toner image onto the continuous form, said fixing means including a pressure roller and a heat roller between which the continuous form passes;

separating means for moving said heat roller and said pressure roller away from each other, and for moving said heat roller and said pressure roller together to nip the continuous form therebetween;

at least one fan for blowing air onto the continuous form in the vicinity of the fixing means in response to said heat roller and said pressure roller moving away from each other by said separation means;

a pair of rollers disposed downstream of said fixing means along the feeding path, said pair of rollers nipping the continuous form therebetween;

rotating means for continuously rotating said pair of rollers in a downstream feeding direction, said rotating means maintaining tension in said continuous form when said continuous form stops moving; and a shield extending along a circumference of said heat roller, disposed between said heat roller and said at least one fan, effective to shield said heat roller from air flow from said at least one fan.

23. The sheet drying prevention device according to claim 22, wherein a first gap is formed between said pressure roller and the continuous form, and a second gap is formed between said heat roller and the continuous form, in response to said heat roller and said pressure roller moving away from each other.

24. The sheet drying prevention device according to claim 23, wherein the pair of rollers holds the continuous form out of contact with said heat roller and out of contact with said pressure roller.

25. The sheet drying prevention device according to claim 24, wherein said rotating means maintains tension in the continuous form in response to said heat roller and said pressure roller moving away from each other.

26. The sheet drying prevention device according to claim 24, further comprising:

a guide plate disposed upstream of said fixing means along the feeding path.

27. The sheet drying prevention device according to claim 23, wherein said rotating means is rotated by a controller at a first speed when said heat roller and said pressure roller nip the continuous form, and a second speed, which is slower than said first speed when said separation means moves said heat roller and said pressure roller away from each other.

28. The sheet drying prevention device according to claim 24, further comprising:

a swingable pushing member between said fixing means and a pair of rollers along the feeding path, said pushing member being swingable into the feeding path.

29. The sheet drying prevention device according to claim 28, further comprising:

operating means for swinging said pushing member into the feeding path in response to the moving of said heat roller and said pressure roller moving away from each other so that said pushing member pushes the continuous form away from said heat roller.

30. The sheet drying prevention device according to claim 23, said at least one fan comprising:

a fan arranged facing said pressure roller, for blowing air into said first gap between said pressure roller and the continuous form.

31. The sheet drying prevention device according to claim 23, said at least one fan comprising:

a fan arranged facing said heat roller, for blowing air into said second gap between said heat roller and the continuous form.

32. The sheet drying prevention device according to claim 23, said at least one fan comprising:

a fan arranged facing said pressure roller, for blowing air into said first gap between said pressure roller and the continuous form, and a fan arranged facing said heat roller, for blowing air into said second gap between said heat roller and the continuous form.

* * * * *